United States Patent [19]

Geschwender

[11] 4,410,214

[45] Oct. 18, 1983

[54] LEISURE CHAIR

[75] Inventor: Robert C. Geschwender, Lincoln, Nebr.

[73] Assignee: Concept Engineering, Inc., Lincoln, Nebr.

[21] Appl. No.: 157,338

[22] Filed: Jun. 9, 1980

Related U.S. Application Data

[63] Continuation-in-part of Ser. No. 945,856, Sep. 26, 1978, Pat. No. 4,208,070.

[51] Int. Cl.[3] ..... A47C 13/00

[52] U.S. Cl. ..... 297/118; 5/432; 297/440; 297/457

[58] Field of Search ..... 297/118, 438, 439, 457, 297/449, 445, 440, 441, 443, 444; 5/432, 433; D6/56, 200, 37, 3

[56] References Cited

U.S. PATENT DOCUMENTS

| | | | |
|---|---|---|---|
| D. 210,579 | 3/1968 | Hehn | D15/8 |
| D. 261,576 | 11/1981 | Heritage | D6/56 |
| 1,409,746 | 3/1922 | McCord | 297/439 X |
| 1,865,030 | 6/1932 | McCauley | 297/378 X |
| 2,119,023 | 5/1938 | Pickard | 297/457 X |
| 2,140,310 | 12/1938 | Brown et al. | 297/438 X |
| 2,209,145 | 7/1940 | Weber | 297/457 X |
| 2,384,234 | 9/1945 | Breese | 297/438 X |
| 2,429,795 | 10/1947 | Blanchard | 297/118 |
| 2,522,394 | 9/1950 | Myers | 297/440 X |
| 2,623,574 | 12/1952 | Damsch | 297/118 X |
| 2,694,438 | 11/1954 | Frech | 297/118 X |
| 2,735,480 | 2/1956 | Mead | 297/438 X |
| 2,803,291 | 8/1957 | Meyer | 297/457 |
| 2,843,181 | 7/1958 | Paschen | 297/118 X |
| 2,857,957 | 10/1958 | Gay | 5/153 |
| 2,914,116 | 11/1959 | Gohmann | 5/169 |
| 3,110,519 | 11/1963 | Chernivsky | 297/457 X |
| 3,120,008 | 2/1964 | Watson | 5/327 |
| 3,195,954 | 7/1965 | Moreno | 297/441 |
| 3,346,298 | 10/1967 | Champion | 297/457 X |
| 3,469,882 | 9/1969 | Larsen | 297/118 |
| 3,695,702 | 10/1972 | Ingellis | 297/441 |
| 4,064,580 | 12/1977 | Ezekove | 5/169 |

FOREIGN PATENT DOCUMENTS

| | | | |
|---|---|---|---|
| 219201 | 11/1955 | Australia | 297/441 |
| 217870 | 9/1956 | Australia | 297/441 |
| 622588 | 5/1949 | United Kingdom | 297/441 |
| 1288461 | 9/1972 | United Kingdom | 297/441 |

OTHER PUBLICATIONS

Certificate of Invention; "TVEZ Chair"; 7-28-56.

*Primary Examiner*—James T. McCall
*Attorney, Agent, or Firm*—Senniger, Powers, Leavitt and Roedel

[57] ABSTRACT

A leisure chair comprising a knockdown frame having a plurality of component parts, each being substantially planar for compactness. These parts include a pair of separate generally U-shaped frame portions, and a pair of generally L-shaped connectors for interconnecting the ends of the frame portions to form a rigid frame of generally L-shape as viewed from the side. The chair also includes a removable cover which fits over the frame when the component parts of the frame are in assembly, and a cushion swingable relative to the frame about an axis extending transversely of the frame at the connectors. The chair may be used in two different positions on the floor, one in which the cover functions as a backrest and the cushion as a seat, and the other in which the cover presents a reclining surface and the cushion provides a headrest to one reclining on the surface.

10 Claims, 9 Drawing Figures

1
5
7
9
11
13
15
17
19
21
23
25
27
29
35
37
39
41

LEISURE CHAIR

CROSS REFERENCE TO RELATED APPLICATION

This is a continuation-in-part of application Ser. No. 945,856, which was filed Sept. 26, 1978, and which issued on June 17, 1980 as U.S. Pat. No. 4,208,070.

BACKGROUND OF THE INVENTION

This invention relates to a legless leisure chair of the type shown in my above-mentioned application. This chair may be overturned from one position in which it functions as a conventional chair, having a backrest and a cushion extending from the backrest at the bottom of the backrest and providing a seat, to a second position in which the chair serves as a recliner, with the backrest presenting a reclining surface and the cushion providing a backrest for one reclining on the surface. The chair comprises a generally rectangular tubular frame of one-piece construction bent on a line extending transversely of the frame so as to be generally L-shaped as viewed from the side. While this chair has proven to be generally satisfactory, it is also relatively bulky, making packaging, shipment and storage of the chair more difficult and expensive.

SUMMARY OF THE INVENTION

Among the several objects of this invention may be noted the provision of a legless leisure chair which may selectively be placed on the floor, for example, in one of two positions for either sitting or reclining on the chair on the floor; the provision of such a chair having a knockdown frame for enabling the chair to be compactly packaged, shipped and stored; the provision of such a chair which may readily be assembled without the use of fasteners and then readily disassembled; the provision of such a chair which is stable when resting on the floor in either the sitting or reclining position; the provision of such a chair which is readily movable from one position to the other; the provision of such a chair which is comfortable in use and pleasing in appearance; the provision of such a chair which is easy to clean; and the provision of such a chair which is simple in design for economical manufacture.

Generally, a leisure chair of this invention comprises a knockdown frame having a plurality of component parts, each being substantially planar for compactness. These component parts include a pair of separate generally U-shaped frame portions, one constituting a support frame portion and the other constituting a backrest frame portion, and a pair of generally L-shaped connectors adapted for a telescopic fit with the ends of the frame portions to form a rigid frame of generally L-shape as viewed from the side. The chair further includes a removable cover adapted to fit over the frame when the component parts of the frame are in assembly, and a cushion swingable relative to the frame about an axis extending transversely of the frame at the connectors. When assembled, the chair is adapted to be positioned on a floor in a first position in which the support portion of the frame rests flat on the floor and the backrest frame portion at one end of the support portion constituting its front end extends upwardly and rearwardly from said one end of the support portion with the cover providing a backrest, and in which said cushion extends forwardly from the frame and rests on the floor for providing a seat. The chair may be overturned from said first position to a second position in which the support portion of the frame extends upwardly from the floor and the backrest frame portion slopes downwardly from the upper end of the support portion to the floor with the cover presenting a reclining surface, the cushion being swingable to a position in which it rests substantially flat against the reclining surface to provide a headrest for one reclining on the surface. The support and backrest frame portions are formed for nonrocking engagement with the floor when the chair is in its second position. Other objects and features will be in part apparent and in part pointed out hereinafter.

BRIEF DESCRIPTION OF THE DRAWINGS

Corresponding reference characters indicate corresponding parts through the several views of the drawings.

DESCRIPTION OF THE PREFERRED EMBODIMENT

Figure 1:
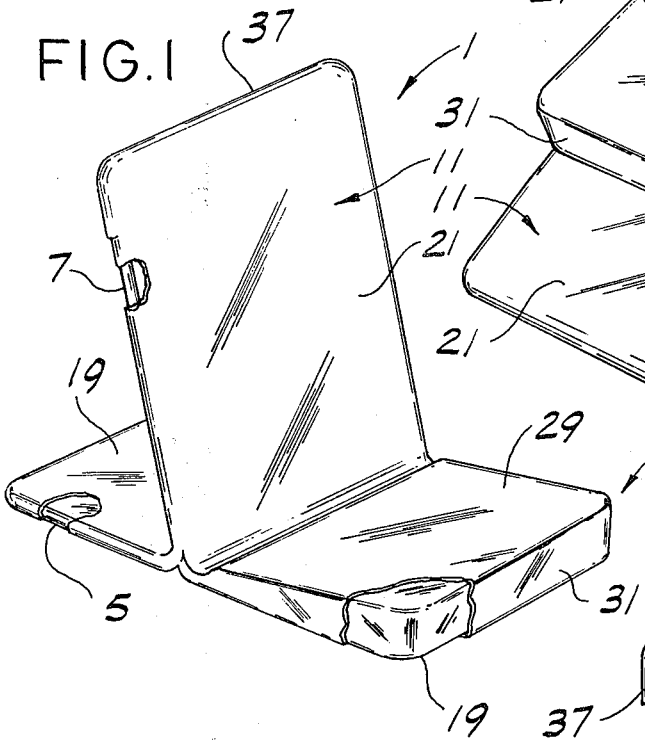
FIG. 1 is a perspective of a chair of this invention on the floor in a "sitting" position.
Figure 3:
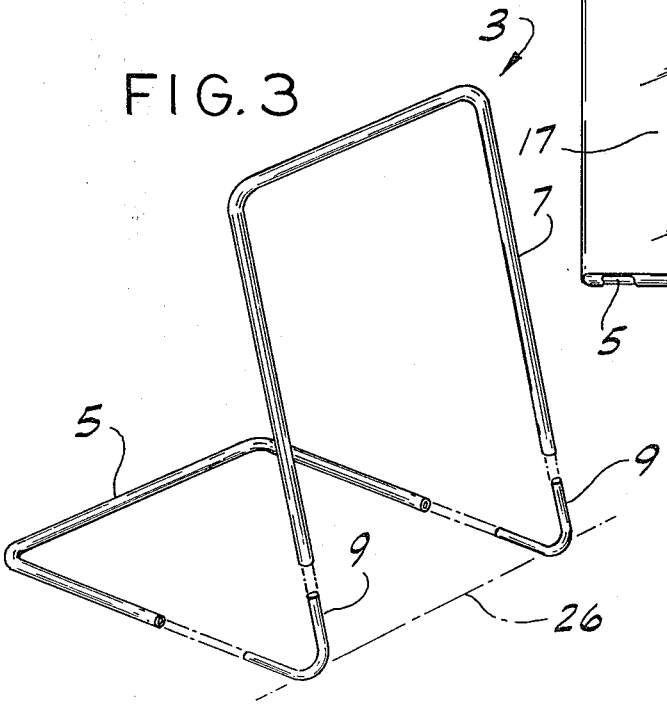
FIG. 3 is a perspective of the chair of FIG. 1 with the cover and cushion removed from the frame and the frame exploded to illustrate its component parts.
Figures 5, 6, 7, 8, 9:
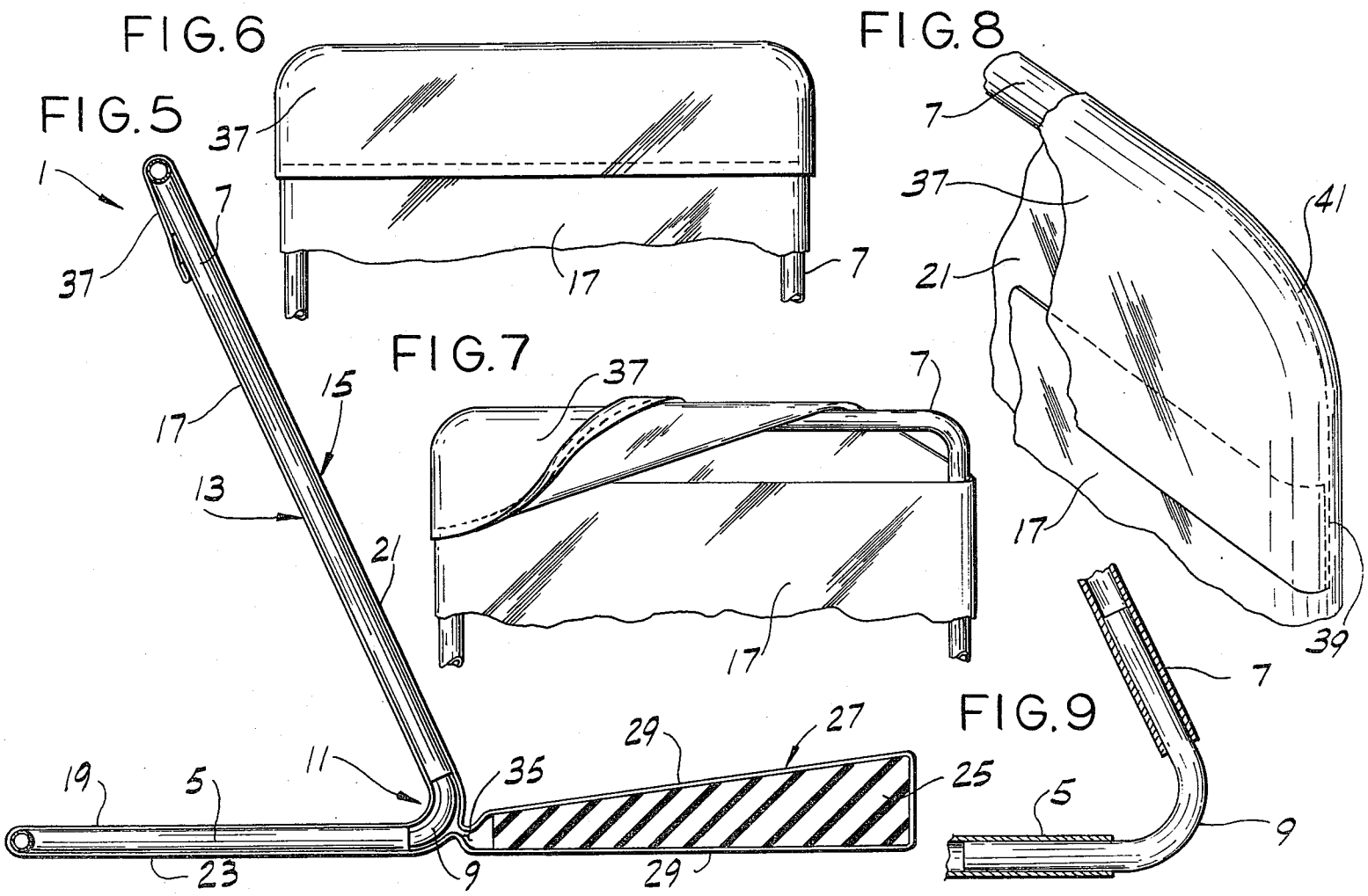
FIG. 5 is a section on line 5—5 of FIG. 4.
FIG. 6 is an enlarged view of a portion of FIG. 4.
FIG. 7 is a view similar to FIG. 6 illustrating how the cover is removed from the frame.
FIG. 8 is an enlarged perspective of the right end of FIG. 6, illustrating the construction of the cover.
FIG. 9 is an enlarged side elevation of a portion of the knockdown frame shown in FIG. 3, with parts being shown in section for purposes of illustration.

Referring now to the drawings, particularly to FIGS. 1 and 3, a leisure chair of this invention is designated generally by the reference numeral 1 and is shown to comprise a knockdown frame 3 having a plurality (e.g., four) of component parts. These include a pair of generally U-shaped frame portions, one of which is indicated at 5 and constitutes a support frame portion and the other of which is indicated at 7 and constitutes a backrest frame portion. As shown, each of these frame portions is of round metallic tubing of substantially uniform diameter along its entire length. A pair of generally L-shaped connectors, each designated 9, interconnect the ends of the frame portions to form a rigid frame of generally L-shape as viewed from the side. These connectors 9 are fabricated of round solid rod material and, as shown in FIG. 9, are adapted to be telescopically received in the ends of the tubular frame portions, with the connectors being sized for a relatively snug fit in the frame portions. Each connector is of substantially uniform diameter along its entire length. It will of course be understood that this arrangement could also be reversed, with the connectors being tubular in form and the frame portions telescopically received in the connectors. The included angle between the legs of each connector 9 is less than 90°, and preferably about 70°, for reasons which will appear hereinafter.

It will be noted that the component parts of the frame, that is, the support and backrest frame portions 5, 7 and the two connectors 9, are each generally planar, thereby enabling them to be compactly packaged, shipped and stored.

The chair also includes a removable cover 11 which fits over the frame and is preferably formed to hold the component parts 5, 7 and 9 of the frame in assembly. Cover 11, which envelopes the entire frame, is generally tubular in shape and is of a flexible and preferably washable fabric. For example, if the chair is to be used indoors (as for reading or watching television), the cover may be fabricated of corduroy, and if it is to be used outdoors (as on the patio, beach, swimming pool, park, etc.), it may be of canvas or plastic. When on the frame 3, cover 11 covers both the support and backrest portions 5, 7 of the frame and has opposing walls, indicated generally at 13 and 15, extending between opposite sides of the frame. One of these walls, wall 13, comprises a first section 17 extending between opposite sides of the backrest frame portion 7 at the back (to the left as viewed in FIG. 5) of the latter, and a second section 19 formed integrally with the first section and extending between opposite sides of the support frame portion 5 above the latter. The other wall, wall 15, is also divided into corresponding first and second sections indicated at 21 and 23, respectively, section 21 being at the front (to the right) of the backrest frame portion, and section 23 being beneath the support frame portion. As shown in FIG. 5, these latter two sections 21, 23 are separate at their adjoining ends at the bend in the frame.

Indicated at 25 and swingable relative to the frame about an axis 26 extending transversely of the frame at the bend in the connectors 9 is a cushion held in a pocket, generally designated 27, forming integrally with cover 11 (see FIGS. 1 and 5). More particularly, this pocket 27 comprises a pair of rectangular extensions, each designated 29, extending in face-to-face relation outwardly (to the right) from the adjoining ends of sections 21, 23 and connected at their sides and at their outer ends by an elongate piece 31 of material. The mouth of pocket 27, defined by the adjoining but separate edges of sections 21, 23 of the frame cover 11, is indicated at 35. As shown, cushion 25 is generally wedge-shaped, increasing in thickness as it extends from the frame at the juncture of the support and backrest frame portion 5, 7 and is of a suitable cushioning material, such as foam rubber, for ensuring that the chair is comfortable in use.

The frame cover 11 is closed at one end and open at its other end allowing it to be slipped on and off the frame, and it has an integral end portion or flap 37 at its open end extending from the upper section 21 of wall 15 for covering the outer end of the backrest frame portion 78. As will appear hereinafter, this end portion 37 is eversible for removal from the end of the backrest frame portion thereby permitting the cover to be slipped off the frame.

Figure 2:
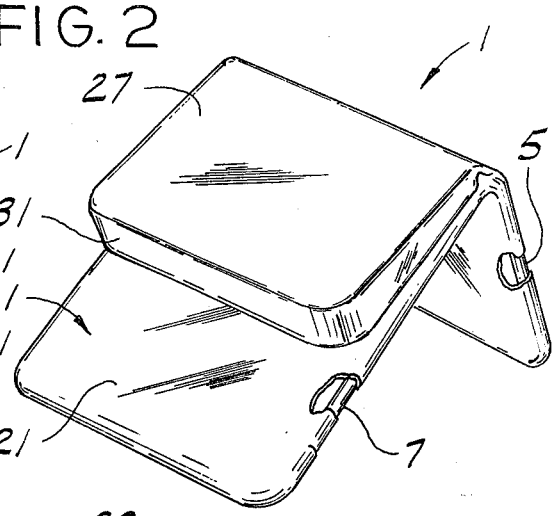
FIG. 2 is a perspective of the chair shown in FIG. 1 overturned to a second "reclining" position.
Figure 4:
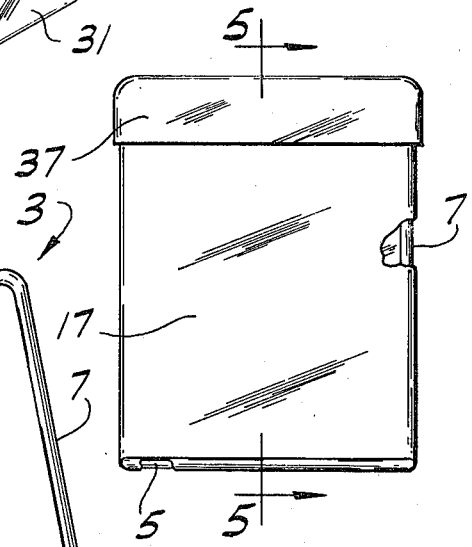
FIG. 4 is a left-end elevation of FIG. 1.

The leisure chair may be positioned on the floor, for example, in one of two positions. In a first position, hereinafter referred to as the "sitting" position (FIGS. 1 and 5), the support portion 5 of the frame rests flat on the floor and the backrest frame portion 7 extends upwardly and rearwardly (to the left as viewed in FIG. 5) from the front (right) end of the support frame portion, an acute angle equal to the included angle between the legs of each connector 9 thus being formed between the support and backrest frame portions. As stated above, this angle is preferably about 70°, which is a comfortable inclination at which to sit. The cushion 25 extends forwardly from the frame and rests on the floor for providing a seat, and the cover 11 extending between opposite sides of the backrest frame portion 7 provides a backrest to one sitting on the cushion. The chair may readily be overturned on the floor to a second "reclining" position, shown in FIG. 2, in which the support portion 5 of the frame extends up from the floor and the backrest frame position 7 slopes down from the upper end of the support portion to the floor with the cover 11 presenting a reclining surface. When the chair is in this position, the cushion 25 in its pocket 27 may be swung relative to the frame so that it rests substantially flat against section 21 of the cover to provide a headrest for one reclining on the chair.

It will be observed that the frame 3 of the chair of this invention is formed for nonrocking engagement with the floor when the chair is in its reclining position. More specifically, each of the corners of the generally rectangular frame are bent on a relatively small radius of curvature with the outer ends of the support and backrest frame portions 5, 7 between the corners being straight for nonrocking engagement with the floor. Thus, it will be apparent that the chair is stable when resting on the floor in either its sitting or reclining position. Other frame configurations may also be suitable for stably supporting the chair in either of these two positions.

The end portion or flap 37 at the outer end of section 21 of wall 15 of the frame cover 11 has a width approximately equal to that of the cover walls 13, 15 and, as shown best in FIGS. 5 and 6, extends from the upper section 21 of wall 15 up over the end of the backrest frame portion 7 and thence back down on the inside of section 21, with the outer end of the flap overlapping the upper margin of section 17 of wall 13 on the outside of that wall. The outer (lower) end of the flap is seamed to section 21 of wall 15 of the cover at the sides of the frame along the side margins of the flap, as shown at 39, thus forming a pocket with the outer end of the backrest frame portion 7 being received therein. The flap is also seamed at each of its sides along lines of stitching 41 (FIG. 8) so that it conforms to the round corners of the frame for enhancing the attractiveness of the chair.

The cover 11 is removable from the frame by pulling the lower end of flap 37 up over the top of the backrest frame portion 7 to an everted position on the outside of section 21 of wall 15 of the cover (see FIG. 7) thereby to allow the cover to be slipped off the frame to be cleaned. Prior to cleaning of the cover, the cushion 25 may be removed from its pocket 27 by pulling it through the mouth 35 of the pocket and thence out of the open end of the frame cover.

In view of the foregoing, it will be apparent that a leisure chair of this invention may be used for watching television, for example, in either a sitting or reclining position on the floor and is constructed to be stable when resting on the floor in either position. Moreover, since frame 3 is a knockdown frame, the chair may readily be assembled (without the use of fasteners) and disassembled for convenient transport and storage. The fact that the cover 11 is removable and of a washable fabric is also advantageous inasmuch as it may be readily cleaned. And the simple design of the chair makes it pleasing in appearance as well as economical to produce.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A leisure chair comprising a knockdown frame having only four component parts, each being substantially planar for compactness, said component parts including a pair of separate generally U-shaped frame portions, one constituting a support frame portion and the other constituting a backrest frame portion and each being formed from one relatively long piece of bent metal, and a pair of relatively short generally L-shaped connectors adapted for a telescopic fit with the ends of said frame portions to form a rigid frame of generally L-shape as viewed from the side, each L-shaped connector being formed from one relatively short piece of bent metal, a removable cover formed to fit over the frame and to hold said component parts in assembly, and a cushion swingable relative to the frame about an axis extending transversely of the frame at said connectors, said chair, when assembled, being adapted to be positioned on a floor in a first position in which the support portion of the frame rests flat on the floor and the backrest frame portion at one end of the support portion constituting its front end extends upwardly and rearwardly from said one end of the support portion with the cover providing a backrest, and in which said cushion extends forwardly from the frame and rests on the floor for providing a seat, said chair being adapted to be overturned from said first position to a second position in which the support portion of the frame extends upwardly from the floor and the backrest frame portion slopes downwardly from the upper end of the support portion to the floor with the cover presenting a reclining surface, the cushion being swingable to a position in which it rests substantially flat against said surface to provide a headrest for one reclining on said surface, said support and backrest frame portions being formed for nonrocking engagement with the floor when the chair is in said second position.

2. A leisure chair as set forth in claim 1 wherein said frame portions are tubular and the ends of said connectors are telescopically receivable in the ends of said frame portions.

3. A leisure chair as set forth in claim 2 wherein said connectors are sized for a relatively snug telescoping fit in said frame portions.

4. A leisure chair as set forth in claim 1 wherein said cover is of a relatively flexible material and generally tubular in shape, having opposing walls extending between opposite sides of the frame when the cover is on the frame, said cover being closed at one end and adapted for being opened at its other end for permitting the cover to be slipped on and off the frame.

5. A leisure chair as set forth in claim 4 wherein said cover has an end portion at said other end integrally formed with the cover for covering one end of the frame after the cover has been slipped on the frame, said end portion being reversible for removal thereof from said one end of the frame allowing the cover to be slipped off the frame.

6. A leisure chair as set forth in claim 1 wherein said cover further has a pocket formed integrally therewith for holding said cushion.

7. A leisure chair as set forth in claim 6 wherein said pocket is formed for removal of said cushion therefrom.

8. A leisure chair as set forth in claim 1 wherein the thickness of said cushion increases as it extends forwardly from the frame when said chair is in said first position.

9. A leisure chair comprising a knockdown frame having a plurality of component parts, each being substantially planar for compactness, said component parts including a pair of separate generally U-shaped frame portions, one constituting a support frame portion and the other constituting a backrest frame portion, and a pair of generally L-shaped connectors adapted for a telescopic fit with the ends of said frame portions to form a rigid frame of generally L-shape as viewed from the side, a removable cover formed to fit over the frame and to envelop the entire frame for holding said component parts in assembly, and a cushion swingable relative to the frame about an axis extending transversely of the frame at said connectors, said chair, when assembled, being adapted to be positioned on a floor in a first position in which the support portion of the frame rests flat on the floor and the backrest frame portion at one end of the support portion constituting its front end extends upwardly and rearwardly from said one end of the support portion with the cover providing a backrest, and in which said cushion extends forwardly from the frame and rests on the floor for providing a seat, said chair being adapted to be overturned from said first position to a second position in which the support portion of the frame extends upwardly from the floor and the backrest frame portion slopes downwardly from the upper end of the support portion to the floor with the cover presenting a reclining surface, the cushion being swingable to a position in which it rests substantially flat against said surface to provide a headrest for one reclining on said surface, said support and backrest frame portions being formed for non-rocking engagement with the floor when the chair is in said second position.

10. A leisure chair as set forth in claim 1 wherein each component part of said frame is of substantially uniform diameter along its entire length.

* * * * *